US005607017A

United States Patent [19]

Owens et al.

[11] Patent Number: 5,607,017

[45] Date of Patent: Mar. 4, 1997

[54] DISSOLVABLE WELL PLUG

[75] Inventors: Steve Owens, Katy; Brett Bouldin, Pearland; Napoleon Arizmendi, Magnolia, all of Tex.

[73] Assignee: PES, Inc., The Woodlands, Tex.

[21] Appl. No.: 497,782

[22] Filed: Jul. 3, 1995

[51] Int. Cl.[6] ..... E21B 33/13; E21B 36/04

[52] U.S. Cl. ..... 166/288; 166/64; 166/302; 166/317

[58] Field of Search ..... 166/317, 376, 166/285, 291, 292, 179, 192, 288, 64, 57, 60, 302

[56] References Cited

U.S. PATENT DOCUMENTS

| | | | |
|---|---|---|---|
| 3,141,513 | 7/1964 | Davis | 166/300 X |
| 3,164,206 | 1/1965 | Sharp | 166/300 |
| 3,208,530 | 9/1965 | Allen et al. | 166/292 X |
| 3,420,299 | 1/1969 | Cloud | 166/292 |
| 5,479,986 | 1/1996 | Gano et al. | 166/292 |

*Primary Examiner*—Stephen J. Novosad

[57] ABSTRACT

An apparatus and method for selectively restricting fluid flow in a well or well conduit. A dissolvable core material is positioned in the well and is isolated from the well fluids with an inpermeable sheath. The sheath is punctured with a control mechanism or other device so that the sheath is breached. The fluid dissolves the core material and permits fluid flow through the well or well conduit. The sheath can be punctured by pressurizing the well fluid, or by controlling the fluid pressure to activate a pressure sensitive control mechanism.

6 Claims, 2 Drawing Sheets

DISSOLVABLE WELL PLUG

BACKGROUND OF THE INVENTION

The present invention relates to a well plug and method for selectively restricting fluid flow in a well. More particularly, the present invention relates to an improved apparatus and method for installing a dissolvable plug in a well and for selectively contacting the well plug with a fluid to dissolve the plug.

Well completion equipment is installed in hydrocarbon producing wells to facilitate the production of hydrocarbons from subsurface formations to the well surface. Temporary plugs are installed in the production tubing to accomplish various tasks. For example, a temporary plug can be installed in the lower end of the production tubing to permit tests for the pressure bearing integrity of the tubing. Additionally, the plug can permit the selective pressurization of the tubing to permit the operation of pressure sensitive tools within the tubing.

Temporary plugs are typically removed from the well by mechanical retrieval techniques such as wirelines, slick lines, and coiled tubing. Because other well operations cannot be performed during such work, the retrieval of the temporary plug delays the well operations and adds additional cost to the well operations.

Various techniques have been developed to reduce the time necessary to retrieve temorary well plugs. For example, one technique uses a phenolic disk packed with explosives. An electrical signal to an actuator activates the explosives and fractures the phenolic disk. This technique requires hazardous explosives and leaves phenolic fragment chunks in the well that can interfere with other well completion equipment.

Another temporary plug technique uses a glass disk to temporarily seal the well tubing. When ruptured with fluid pressure or mechanical devices, the glass fractures into small slivers to open the tubing bore. Although the glass fragments are smaller than the fragments left by a phenolic disk, the glass disks are brittle and do not reliably support large differential fluid pressures within the well. The glass disks can inadvertently rupture, leading to failure of the completion operations.

Accordingly, a need exists for a temporary well plug that does not interfere with well completion activities, that reliably seals production tubing in a well, and that does not leave plug fragments within the well or well tubing.

SUMMARY OF THE INVENTION

The present invention provides an apparatus and method for selectively controlling fluid flow in a well. The apparatus includes a core material that is dissolvable when contacted by the fluid, an impervious sheath for preventing contact between the fluid and the core material, and a control mechanism for selectively causing a breach of the sheath to contact the fluid and core material. The core material and sheath cooperate to restrict fluid flow within the well until the control mechanism causes the fluid to contact and to dissolve the core material.

In other embodiments of the invention, a stored fluid can be separated from the core material, and the control mechanism can selectively cause the stored fluid to contact and to dissolve the core material. The control mechanism can comprise pressure variations of the fluid, can comprise an apparatus responsive to the fluid pressure, or can comprise a heating element that weakens a material to breach the sheath.

The method of the invention is practiced by positioning a dissolvable core material in the well to restrict fluid flow through the well, wherein the core material is protected by a sheath from contact with the fluid. The sheath is breached to permit contact between the fluid and the core material, thereby dissolving the core material to permit fluid flow through the well.

DESCRIPTION OF THE PREFERRED EMBODIMENTS

Figure 1:
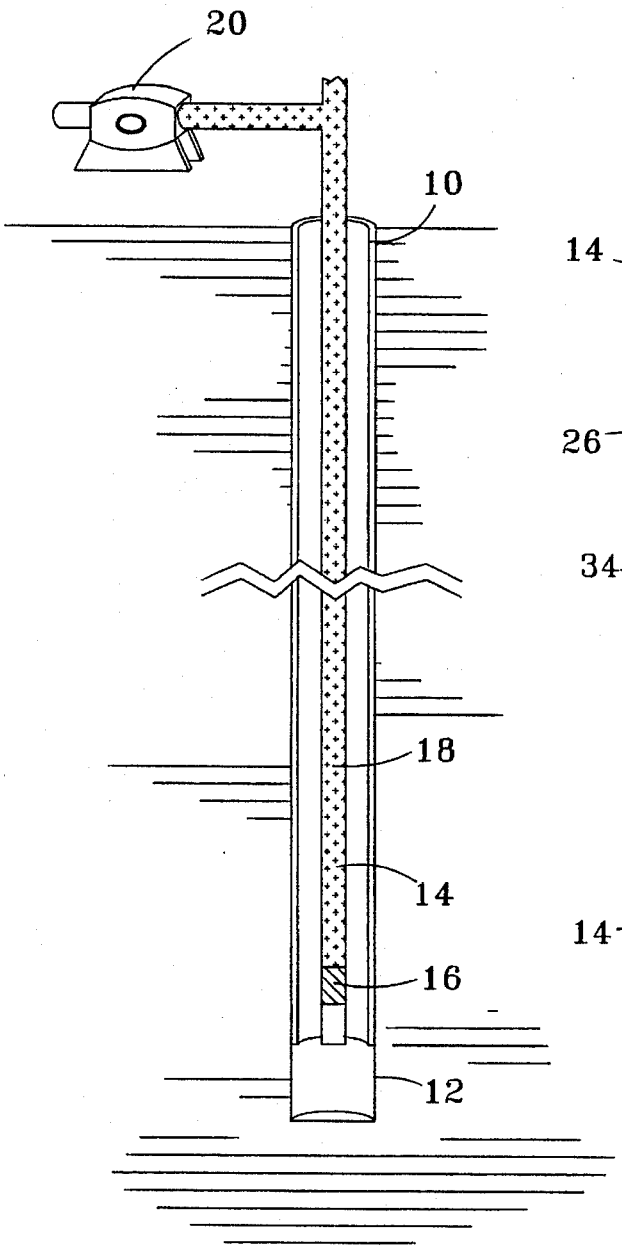
FIG. 1 illustrates the positioning of the invention in a well.

FIG. 1 shows the installation of the present invention in a well such as a hydrocarbon producing well. Casing 10 is positioned in well 12, and production tubing 14 runs through casing 10. Temporary plug 16 is positioned at the lower end of tubing 14, and retains fluid 18 within tubing 14. The pressure of fluid 18 can be controlled with pump 20 located at the surface of well 12. Pump 20 can pressurize fluid 18 to a selected maximum pressure, or can be cycled to change the pressure of fluid 18 to different amounts. Alternatively, pump 20 can cycle the pressure of fluid 18 as a function of time for the purposes described below.

Figure 2:
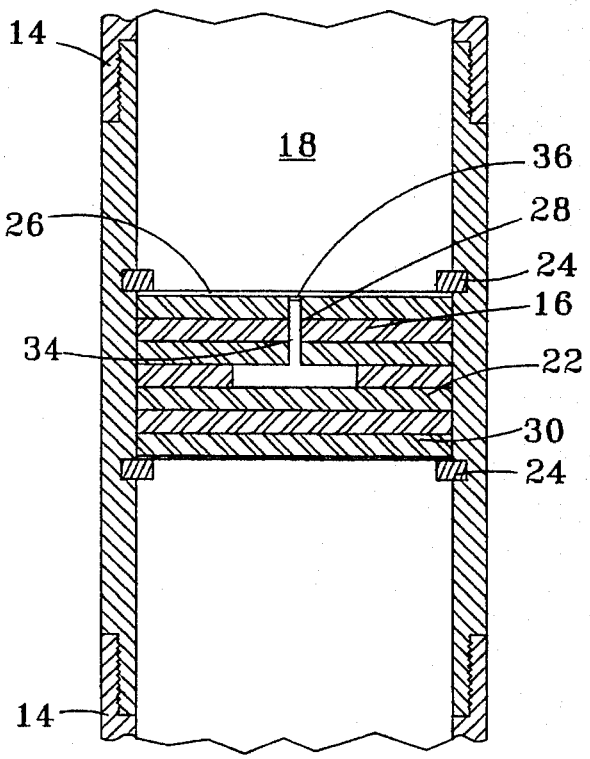
FIG. 2 illustrates an embodiment of the invention wherein the fluid pressure is increased to breach the sheath material.

FIG. 2 illustrates one embodiment of the present invention. Temporary plug 16 is positioned in tubing section 22 of tubing 14, and is retained between rings 24. In this embodiment of the invention, plug 16 generally comprises sheath 26, control mechanism 28, and core material 30.

Core material is defined herein as any material having sufficient strength to retain fluid 18 within tubing 14, and dissolvable when contacted directly by a fluid such as by fluid 18. In one embodiment of the invention, core material 30 can comprise the Series 300–301 dissolvable metal manufactured by TAFA Incorporated of Concord, N.H. Such material has strength and machinability characteristics of certain metals but will disintegrate when exposed to water. As shown in FIG. 2, core material 30 can be configured in different layers or sections 32 to provide additional strength characteristics, or can be formed as a single, integrated material.

Sheath 26 protects core material 30 from premature dissolution caused by contact with fluid 18. Sheath 26 can be formed with various materials, and can cooperate with tubing section 22 to isolate core material 30 from contact with fluid 18. Sheath 26 can be formed from any material impermeable to the passage of fluid 18 over the desired time, such as Viton, Nitrile, Teflon or other materials known in the art.

Control mechanism 28 can be accomplished in different ways within the scope of the invention, and can be accomplished with various materials, mechanical tools or structural configurations. As shown in FIG. 2, control mechanism can comprise void 34 in core material 30, wherein void 34 includes aperture 36 sealed with sheath 26. In this form of the invention, the pressure of fluid 18 can be increased until the shear strength of sheath 26 across the dimension of aperture 36 is exceeded beyond the yield limit. When this limit is exceeded, sheath 26 will be pierced and fluid 18 will enter void 34 to dissolve core material 30. As shown in FIG. 2, void 34 can be configured to maximize the surface area of core material 30 in contact with fluid 18, for the purpose of accelerating the dissolution of core material 30 after sheath 26 is punctured.

In another embodiment of the invention, "control mechanism" can be defined as a sheath 26 formed with a material that deteriorates as a function of time when exposed to fluid 18. In this embodiment of the invention, the thickness or composition of the material in dissolvable sheath 26 can be selected to accomplish the desired protection for core material 30.

When core material 30 is dissolved by fluid 18 to a degree where core material 30 cannot support the force exerted by fluid 18, core material 30 and sheath 26 will collapse, thereby removing plug 16 from tubing 14. Even if such collapse occurs before core material 30 completely dissolves, core material 30 continues to dissolve so that particles of core material residue are not left in tubing 14. In other embodiments of the invention, sheath 26 can be designed so that the remnants of sheath 26 are retained and are not released loosely within tubing 14 to interfere with other well completion equipment.

Figure 3:
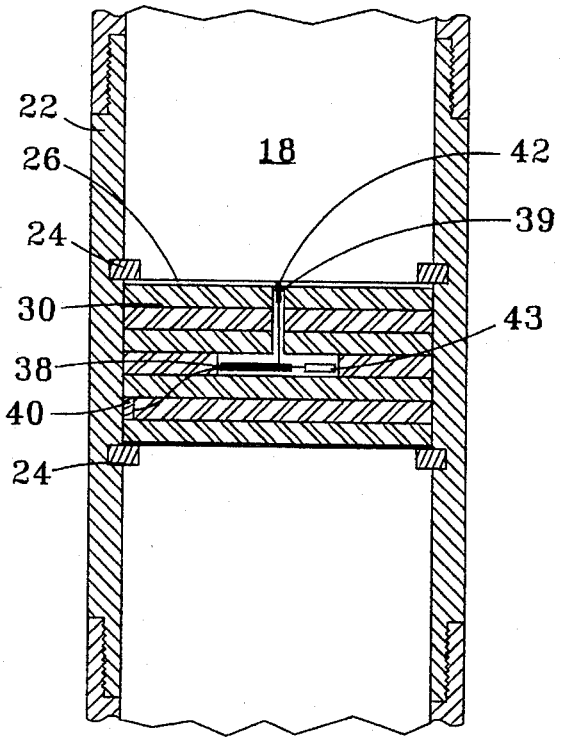
FIG. 3 illustrates an embodiment of the invention having a heat sensitive member and heating element for breaching the sheath.
Figure 4:
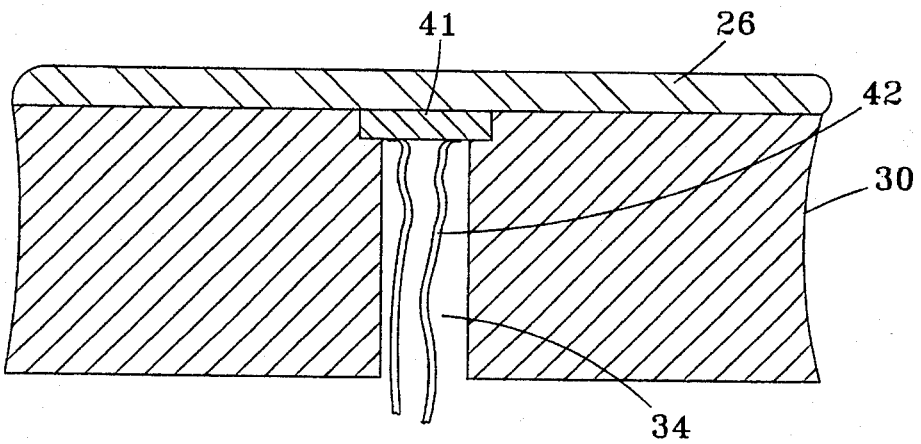
FIG. 4 illustrates detail of a resistance wire element.

Referring to FIG. 3, another embodiment of control mechanism is shown wherein a pressure sensitive apparatus can be actuated to expose fluid 18 to core material 30. Electronic PCBA 38 can be connected with strain guage 40 attached to tubing section 22. When the pressure of fluid 18 reaches a selected level or is cycled in a selected sequence, strain guage 40 triggers PCBA 38 to activate device 39 for puncturing sheath 26. As shown in FIGS. 3 and 4, such device can comprise a temperature sensitive material 41 in contact with sheath 26 and with resistance wire 42. When PCBA 38 causes current to flow through resistance wire 42, the resulting increase in temperature will weaken temperature sensitive material 39 until the pressure of fluid 18 causes failure of sheath 26. In this embodiment of the invention, the material selected for sheath 26 preferably has a finite elasticity which is reduced when the temperature of sheath 26 is increased.

Alternatively, the current generated by PCBA 38 could be used to power various mechanical devices for puncturing sheath 26. The power to PCBA 38 can be supplied with a wire from the well surface, with battery 43, or through other transmission or communication techniques known in the art.

Figure 5:
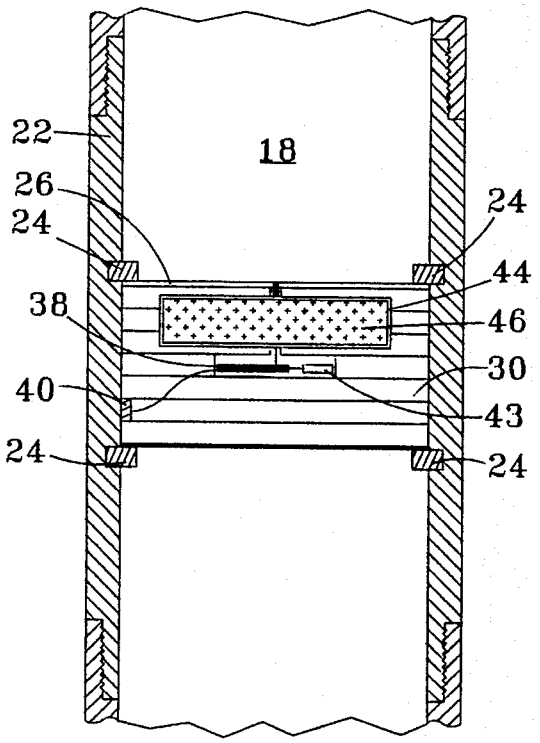
FIG. 5 illustrates a stored fluid for selectively contacting the core material.

FIG. 5 illustrates another embodiment of the invention, wherein sheath 44 isolates core material 30 from stored fluid 46. Control mechanism 48 selectively punctures sheath 44 to permit contact between stored fluid 46 and core material 30 to cause the dissolution of core material 30. In this embodiment of the invention, core material 30 can be removed from tubing 14 even if there is no fluid such as fluid 18 within tubing 14.

The present invention is useful in any application wherein a temporary plug is desired. Although the phrase "temporary plug" is used throughout, it should be understood that the invention can be substituted for permanent plugs in a well. In this use the invention can provide the function-of a permanent well plug while providing the operational flexibility provided by a temporary plug.

The configuration and shape of the sheath or core material can be modified to provide different results at different times. For example, multiple sheaths and segregated quantities of core materials can be configured to selectively open the wellbore at different rates, and at different times. This design permits fluid flow to be throttled through the well as a selected rate. In other embodiments of the invention, the core material can be formed in a honeycombed or similar structure to provide maximum compressive strength with the minimum amount of core material.

Although the invention has been described in terms of certain preferred embodiments, it will be apparent to those of ordinary skill in the art that various modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for selectively controlling fluid flow in a well, comprising:

a core material that is dissolvable when contacted by the fluid;

a sheath impervious to the fluid for preventing contact between the fluid and said core material, wherein said sheath and core material cooperate to restrict the flow of the fluid through the well; and a control mechanism including a thermal sensitive material that can be weakened by heat and a heating element for selectively heating said thermal sensitive material so that the fluid breaches said thermal sensitive material and contacts said core material, thereby causing the dissolution of said core material to permit fluid flow through the well.

2. An apparatus for selectively controlling fluid flow in a well, comprising:

a core material dissolvable when contacted by the fluid;

a sheath impervious to the fluid for preventing contact between the fluid and said core material, wherein said sheath and core material cooperate to restrict the flow of the fluid through the well;

a valve for selectively causing the fluid to contact said core material; and a control mechanism engaged with said valve for selectively causing the breach of said sheath to permit contact between the fluid and said core material, thereby causing the dissolution of said core material to permit fluid flow through the well.

3. An apparatus for selectively controlling fluid flow in a well, comprising:

a core material that is dissolvable when contacted by the fluid;

a sheath impervious to the fluid for preventing contact between the fluid and said core material, wherein said sheath and core material cooperate to restrict the flow of the fluid through the well;

a control mechanism for selectively causing the breach of said sheath to permit contact between the fluid and said core material, thereby causing the dissolution of said core material to permit fluid flow through the well; and an aperture in said core material for increasing the surface area of the fluid in contact with said core material when said control mechanism contacts the fluid and said core material.

4. An apparatus for selectively controlling flow of a well fluid through a conduit in a well, comprising:

a housing for engaging the conduit at a selected position in the well;

a core material attached to said housing that is dissolvable when contacted by the well fluid;

a fluid impervious sheath located between said core material and the fluid;

a control mechanism for selectively causing the breach of said sheath to permit contact between the fluid and said core material, thereby causing the dissolution of said core material to permit fluid flow through the conduit;

a thermal sensitive material that can be weakened by heat; and a heating element engaged with said control mechanism for selectively heating said thermal sensitive material to cause contact between the fluid and said core material.

5. An apparatus as recited in claim 4, wherein said thermal sensitive material contacts a portion of said sheath so that weakening of said thermal sensitive material causes a breach through said sheath to permit contact between the fluid and said core material.

6. A method for selectively controlling fluid flow in a well, comprising the steps of:

positioning a dissolvable core material in the well to restrict fluid flow through the well, wherein a fluid impermeable sheath prevents the fluid from contacting said core material; and heating a heat sensitive material so that the fluid pressure breaches said sheath; and contacting the fluid and said core material to dissolve said core material and to permit fluid flow through the well.

* * * * *